United States Patent [19]

Eberhardt et al.

[11] Patent Number: 4,979,693

[45] Date of Patent: Dec. 25, 1990

[54] PORTABLE HOSE REEL

[75] Inventors: H. Alfred Eberhardt, Paoli; Richard E. Teske, Norristown; David L. Miller, Conshohocken, all of Pa.

[73] Assignee: Hale Fire Pump Company, Conshohocken, Pa.

[21] Appl. No.: 324,590

[22] Filed: Mar. 16, 1989

[51] Int. Cl.[5] ..... B65H 75/40

[52] U.S. Cl. ..... 242/96; 242/64; 242/86; 242/86.4; 137/355.16; 137/355.19; 137/355.2

[58] Field of Search ..... 242/64, 68, 75.4, 75.45, 242/77, 86, 86.1, 86.4, 96, 99; 137/355.16, 355.19, 355.2, 355.21, 355.23, 355.26, 355.27, 355.28

[56] References Cited

U.S. PATENT DOCUMENTS 975,245 11/1910 Hughes ..... 242/86.4
2,071,731 2/1937 Craig et al. ..... 242/86 X
2,403,277 7/1946 Hall ..... 137/355.26 X
2,426,984 9/1947 Craig ..... 242/86
3,184,180 5/1965 Rockwell ..... 242/86
3,576,196 5/1969 Antanosian ..... 137/355.26
4,306,688 12/1981 Hechler ..... 242/96 X
4,520,239 5/1985 Schwartz ..... 242/96 X
4,537,215 8/1985 Roman ..... 137/355.16 X

FOREIGN PATENT DOCUMENTS 929975 6/1963 United Kingdom ..... 242/86.1

*Primary Examiner*—Joseph J. Hail, III
*Assistant Examiner*—Paul Thomas Bowen
*Attorney, Agent, or Firm*—Frank A. Follmer

[57] ABSTRACT

A portable hose reel for deploying a pair of hoses quickly and easily is disclosed. The hose reel has two flexible hoses wound in a flattened condition one on top of the other on a reel and a handle is provided for use in carrying and unreeling of the hoses.

20 Claims, 6 Drawing Sheets

PORTABLE HOSE REEL

BACKGROUND AND SUMMARY OF THE INVENTION

This invention relates to a portable hose reel for use, for example, in the closed loop operation of water powered devices. The hose reel in accordance with the invention is designed for use in firefighting applications where it is important to deploy a pair of hoses at the scene of a fire as fast as possible. A specific application of the hose reel of the invention is to provide the supply and return hoses for a water driven fan of the type disclosed in copending application Ser. No. 319,548, filed Mar. 6, 1989.

It is the general object of the invention to provide a portable hose reel of the indicated type which is light in weight, compact and capable of deploying two hoses at the same time.

Briefly stated, the portable hose reel in accordance with the invention comprises a reel made of a frame having a pair of circular side plates secured together in spaced apart, opposed relation to define an annular space therebetween for receiving wound hose and an axle mounted at the center of the frame to extend between the side plates on a transverse axis. The hose reel also includes a pair of hoses wound in a flattened condition one on top of the other within the space provided by said reel. The hose reel also comprises a transport means including a pair of arms rotatably mounted at one end to the axle and extending to a location radially outwardly from the outer rim of the side plates whereat a handle means is secured in an arrangement such that it can be gripped for the transporting of the hose reel.

A feature of the invention is the construction whereby the hose reel is made to be light in weight. For example, an actual embodiment of the invention for a pair of 50 foot fire hoses having a 2 ½ inch diameter weighs only about 33 pounds and is less than 30 inches in height.

Another feature of the invention is the design of the reel to provide a stowage area for the couplings on the inner ends of the hoses.

Another feature of the invention is the provision of a novel handle construction whereby the handle can be used in two positions, a first position for carrying or storing the hose reel with the reel and hoses held in a locked position and a second position for unreeling the hoses from the reel to deploy the same.

DETAILED DESCRIPTION OF THE PREFERRED EMBODIMENTS

Figure 3:
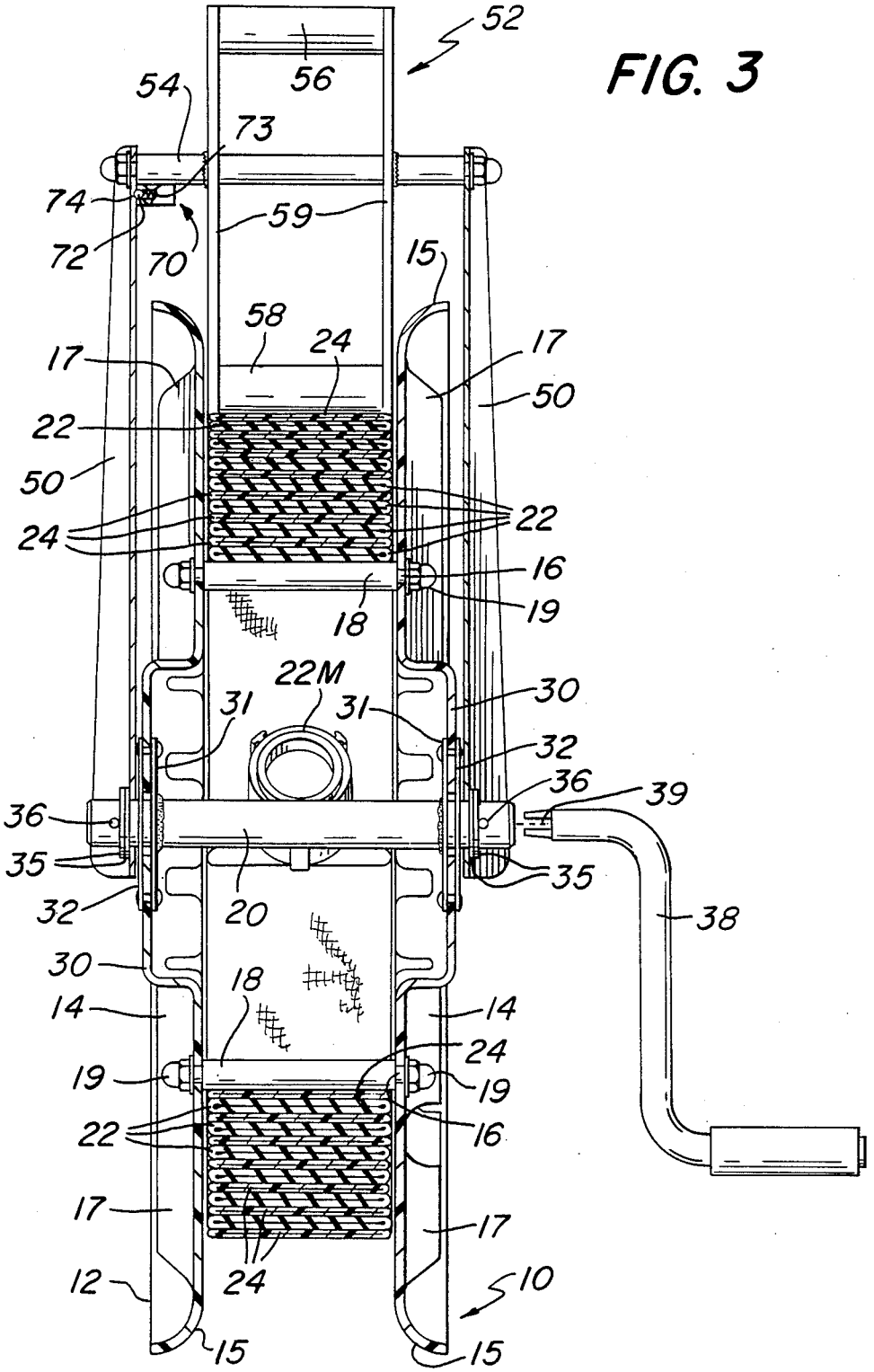
FIG. 3 is a vertical section of the hose reel shown in FIG. 1.

The portable hose reel in accordance with the invention comprises a reel 10 which includes a frame 12 having a generally open cylindrical construction. Frame 12 comprises a pair of circular side plates 14 which are secured together in spaced apart opposed relation by means of four tie bolts 16 and associated spacer sleeves 18. The tie bolts 16 extend through spacer sleeves 18 and have cap nuts 19 threadedly engaged on the outer ends thereof as is best shown in FIG. 3. The reel 10 also includes an axle 20 mounted at the center of side plates 14 of circular frame 12 to extend transversely between the side plates 14 on what may be termed the "rotational axis" of the reel 10. The tie bolts 16 are spaced around axle 20 at locations radially outwardly thereof to provide a central support for hoses to be wound thereon as described hereafter. The tie bolts 16 are spaced radially from axle 20 equally and are spaced apart from one another equally and are thereby arranged in a generally square configuration when viewed from the side as best shown in FIG. 1.

Figure 4:
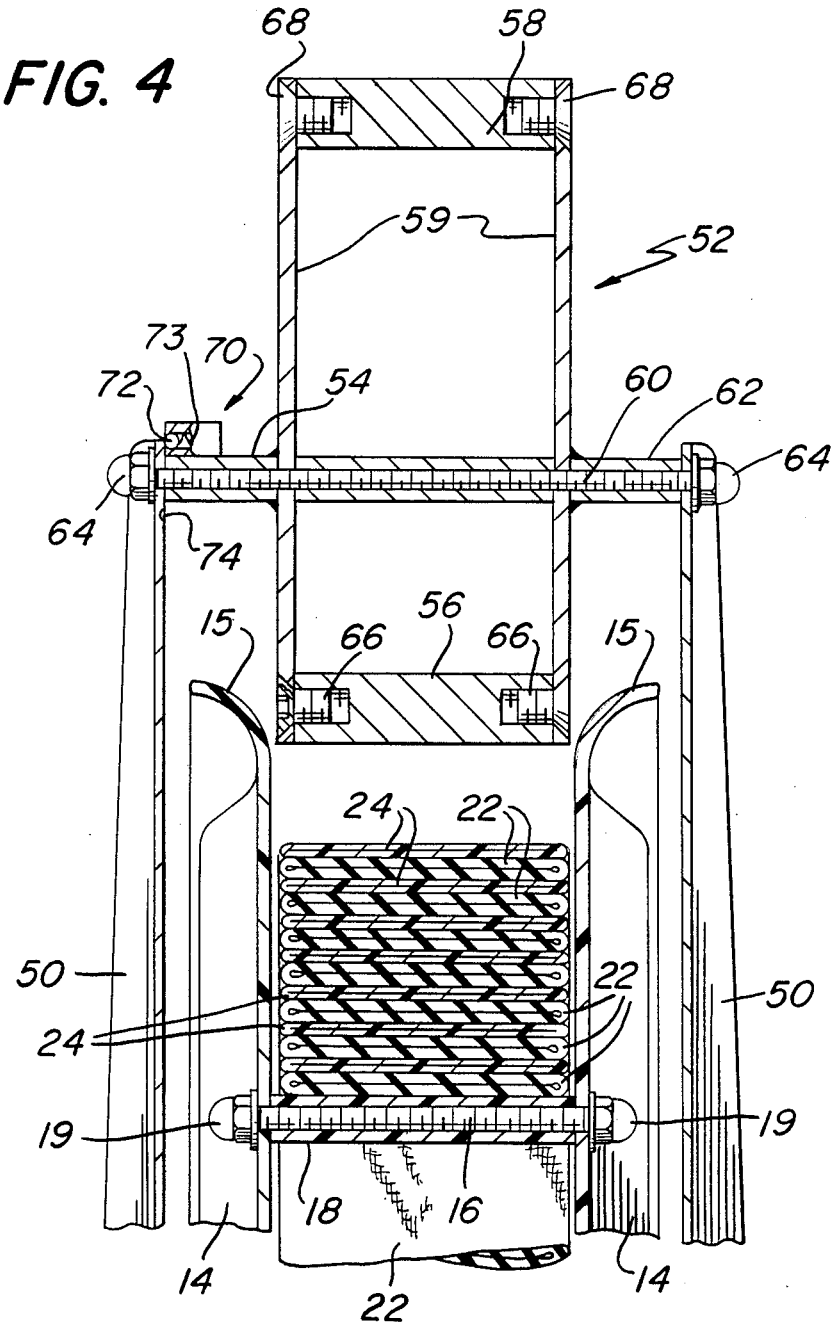
FIG. 4 is a fragmentary vertical section of a part of the hose reel as shown in FIG. 2.

There are provided a pair of flexible hoses 22 and 24 wound in a flattened condition one on top of the other throughout their length within the annular space on the interior of the reel 10, the hoses being wound around the square shaped central support or hub provided by the four tie bolts 16 and spacers 18. Hoses 22 and 24 are typically conventional fire hoses which are flexible so that they can be wound in a flattened condition as is shown in FIGS. 3 and 4 and have conventional male and female couplings 22M, 22F and 24M, 24F, respectively, thereon, as is well known in the art. As is shown in the Drawings, the hoses 22 and 24 are wound one on top of the other throughout their length. In addition, the hoses 22 and 24 are oriented such that the inner ends thereof have a male coupling 22M on hose 22 and a female coupling 24F on hose 24 and at the outer ends thereof have a female coupling 22F on hose 22 and a male coupling 24M on hose 24 as is best shown in FIG. 1. The inner couplings 22M, 24F are located within the confines of the square-shaped hub formed by the tie members 16 and spacers 18 and between the spaced apart side plates 14.

Figure 1:
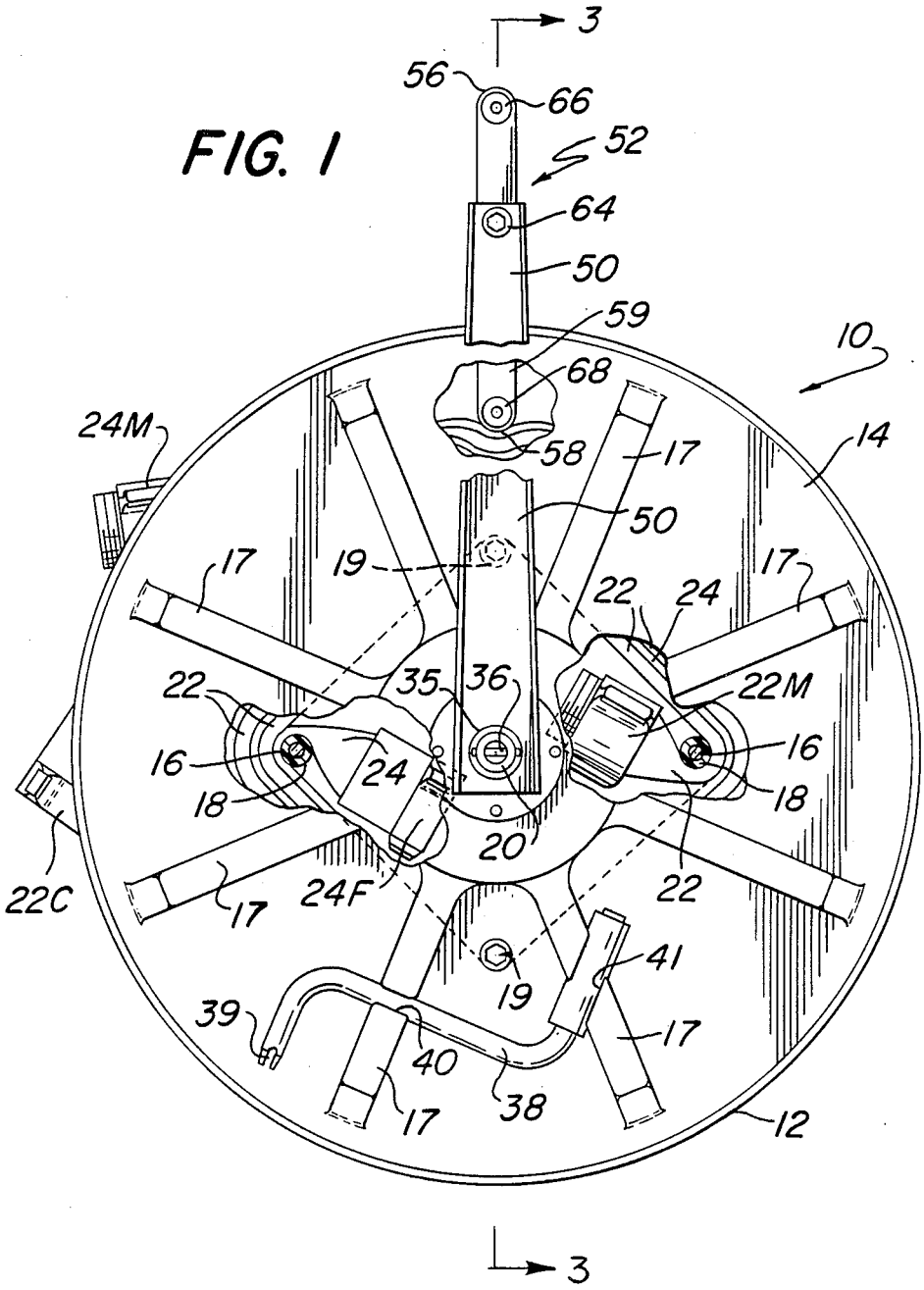
FIG. 1 is a side elevation of a hose reel showing the handle in a first ("hose locking") position.
Figure 2:
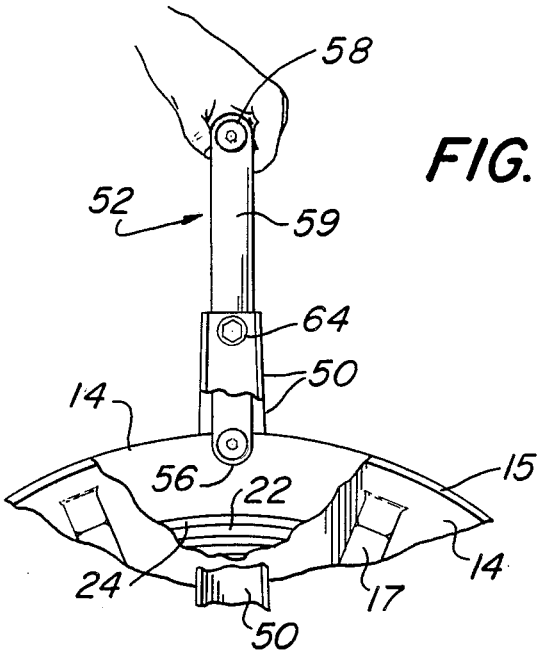
FIG. 2 is a fragmentary side elevational view of the hose reel showing the handle in a second ("hose unreeling") position.
Figure 5:
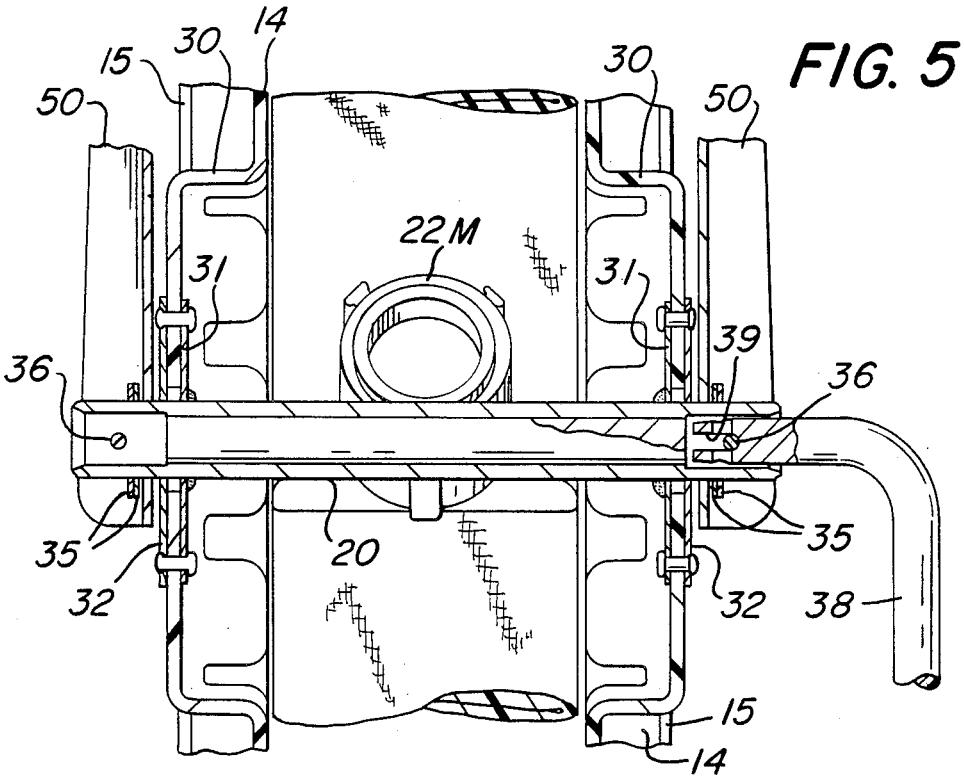
FIG. 5 is an enlarged cross-section of the center portion of the hose reel showing details of construction.

The side plates 14 are made of a strong lightweight plastic material, preferably ABS, and have a plurality (i.e., eight) of radially extending ribs 17 circumferentially equally spaced as shown in FIG. 1 for purposes of providing strength and adding rigidity to the side plates 14. In addition, side plates 14 have a widened hub 30 at the central portion thereof, which hub also serves to add rigidity and strength to the side plates 14. A pair of metal circular plates 31 are secured to axle 20, as by welding, at a location adjacent the inside of each of hubs 30 (FIG. 5). Plates 31 are riveted to a similar circular plate 32 located on the outer sides of each of the hubs 30 of the side plates 14, as is best shown in FIG. 5. The plates 31 and 32 serve to provide a strong central hub portion for the side plates 14 for a purpose to be described hereafter.

Axle 20 is made of a tubular metallic construction, preferably aluminum, and thereby provides hollow end portions each of which has a roll pin 36 secured at a location a short distance inwardly from the ends of axle 20, as is best shown in FIG. 5. Each roll pin 36 is mounted in the hollow end of the axle 20 to extend transversely thereto and to the axis of rotation of the reel 10. The construction is such that the hollow end portions of the axle 20 provide access to said roll pins 36 for engagement thereof by a suitable crank 38 for causing rotation of the reel 10. Crank 38 has a recess 39 formed in an end thereof adapted to receive a roll pin 36 for engagement. FIGS. 3 and 5 show the manner in which the crank 38 can be moved into engagement with one of the roll pins 36 for causing rotation of the reel 10 during the winding of the hoses 22 and 24 thereon. The crank 38 is mounted in a pair of recesses 40 and 41 formed in two of the ribs 17 in one of the side plates 14 as is shown in FIG. 1.

The side plates 14 are constructed in a generally dish-like shape and have their outer rims 15 constructed in an outwardly curved configuration, as best shown in FIG. 3. This curved configuration serves as a guide during the winding of the hoses 22 and 24 on the reel 10 and also provides a good supporting and rolling part for the reel 10 when it is rested on or rolled along the ground.

In a typical installation for use in firefighting operations, the hoses 22 and 24 are supply and return hoses made of lightweight, single-jacket construction known in the fire trade as "rack hose". Each of these hoses is typically fifty feet long and 2 ½ inches in diameter in their expanded, round condition.

The portable hose reel of the invention also comprises a transport means for use in either carrying the hose reel in its fully wound condition or for use in unreeling a wound hose by moving the reel to lay out two hoses in a flat condition along the ground. Such transport means comprises a pair of arms 50 rotatably mounted at one end to axle 20 and extending radially outwardly from axle 20 to a location outwardly of the outer rims 15 of the side plates 14. Arms 50 are mounted to the axle 20 at locations outside of the hubs of the side plates 14 and are retained on axle 20 by roll pins 36 and washers 35 positioned between each roll pin 36 and the end of each arm 50 rotatably mounted on the associated end of axle 20. The transport means also includes a handle means 52 secured to and extending between the extended ends of the arms 50 to provide grip means whereat said transport means can be gripped for transporting the hose reel 10 either in the fully wound condition of the hoses or along the ground during an unreeling operation. To this end, the handle means 52 comprises a pivot 54 extending transverely between the spaced apart outer ends of said pair of arms 50 and, a pair of handles 56 and 58 providing a pair of grip portions thereon and means for pivotally mounting the handles on pivot 54. The means for pivotally mounting the handles 56 and 58 comprises a pair or oars 59 pivotally mounted on the pivot 54 at a medial part of the bars 59 with one handle 56 being mounted on one end of bars 59 and the other handle 58 being mounted on the outer end of bars 59. Pivot 54 is constructed of a tie bolt 60 which extends through the interior of a spacer sleeve 62 and is engaged at its outer threaded ends with a pair of cap nuts 64, as shown in FIG. 4. Handles 56 and 58 are mounted on the ends of bars 59 by flathead mounting screws 66 and 68, respectively.

The handle means 52 is constructed and arranged so that one handle 56 is spaced a shorter distance from the pivot 54 than the other handle 58 is spaced from the pivot 54. By this construction and arrangement, the handle means 52 is movable to a first transport position (the "hose locking" position) in which handle 58 is in contact with an outer portion of the wound hoses 22 and 24 for locking reel 10 against rotation relative to arms 50 of the transport means and handle 56 is located outwardly of the outer rims 15 of side plates 14 to provide a grip portion for carrying the hose reel. Handle means 52 is movable between the first transport position and a second transport position (the "hose unreeling" position) in which handle 56 is located in an inward position in the space between said side plates 14 and handle 58 is located in an outer position outwardly of the outer rims 15 of said side plates 14 to provide a grip portion for use in transporting the hose reel to unreel the hoses 22 and 24. As shown in FIG. 4, the inward position of handle 58 is spaced apart from the wound hoses 22 and 24 so that they are not held against any movement, whereby reel 10 is free to rotate relative to the transport means for the unreeling of hoses 22 and 24.

Detent means are provided for holding the handle means in the "hose locking" position. The detent means serves to ensure that the wound hose will not start to unreel, in which event the hose would be difficult to handle and would have to be rereeled to a tight condition. To this end, the bars 59 and the spacer sleeve 62 are welded together for conjoint rotational movement about the tie rod 60. A detent means 70 is mounted on the periphery of sleeve 62 and comprises a detent ball 72 which is spring biased (by spring 73) toward the inwardly facing surface of one of the arms 50, said arm 50 being provided with a recess 74 for receiving the detent ball 72 when the handle means is moved to the "hose locking" position. The cooperation between the detent ball 72 and the arm 50 when ball 72 is in the recess 74 serves to hold the handle means in the "hose locking" position. It will be apparent that when the handle means is moved from the "hose locking" position to the "hose unreeling" position, detent ball 72 can be moved out of its engaging position within the recess 74 by compressing spring 73, as is common with detent means of this type.

Figure 6:
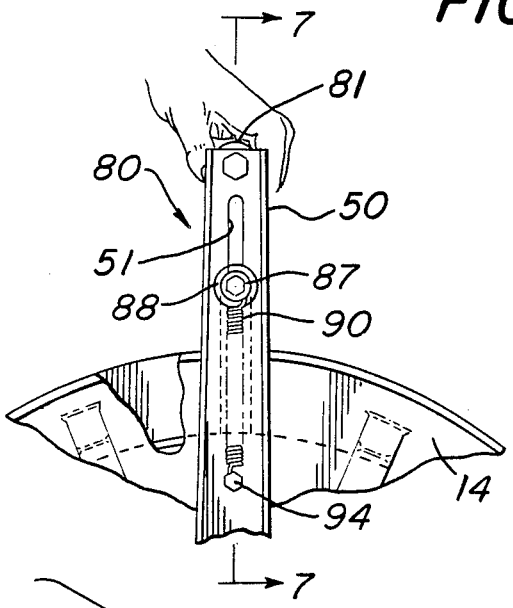
FIGS. 6–8 show another embodiment of the handle construction for the hose reel.
Figure 8:
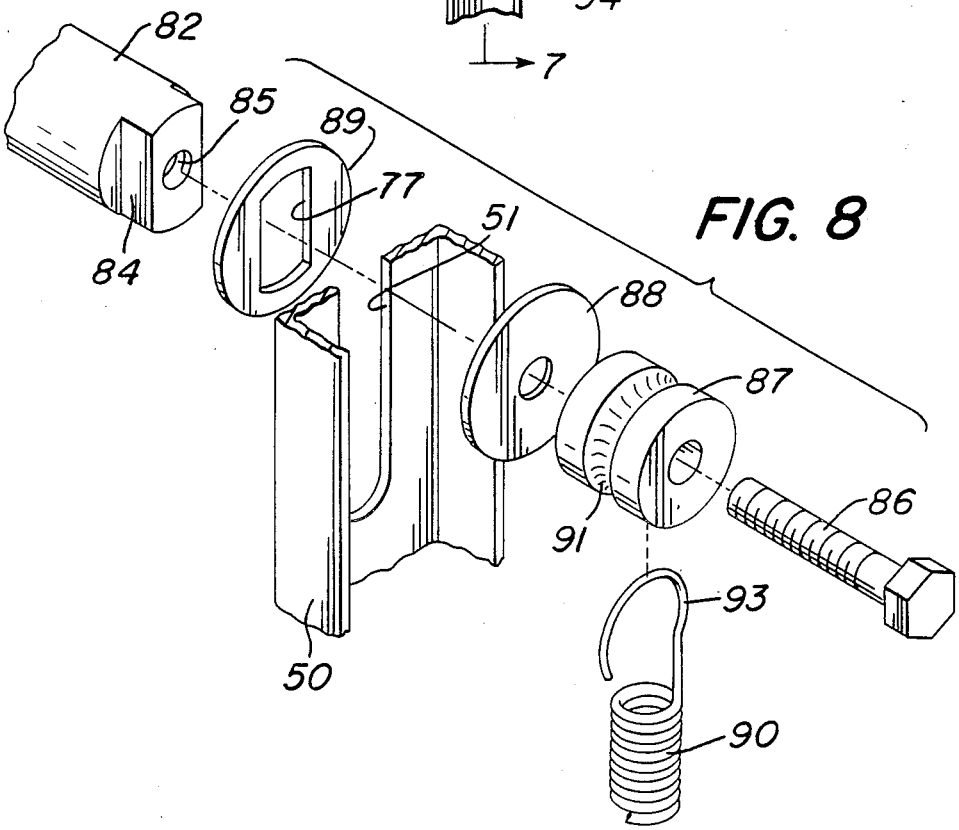
Figure 7:
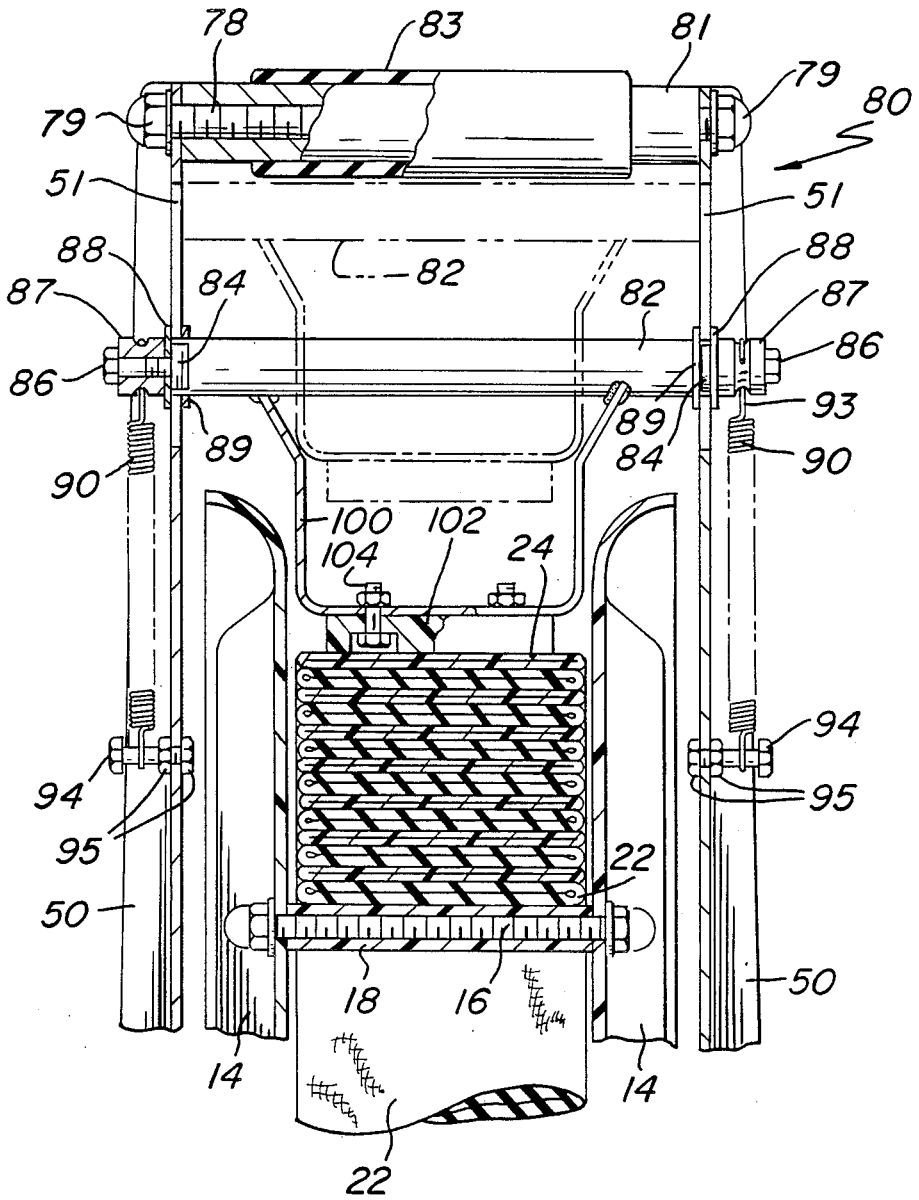

In FIGS. 6–8, there is shown another embodiment of the handle means. This embodiment comprises a very simple and effective means for ensuring that the hose reel stays in its reeled condition when this is desired and even during the rough handling by firemen, such as when the hose reel is stored or it is put on or taken off the fire truck.

Referring to FIGS. 6–8, the handle means is indicated generally as 80 and comprises a first handle 81 mounted on the outer ends of the arms 50 to extend therebetween and having a soft grip 83 thereon. Handle 81 provides a first grip portion for use in transporting of the hose reel. Handle means 80 also comprises a second handle 82 which is movably mounted on the arms 50 at a location radially inwardly of handle 81. Means are provided for mounting handle 82 for slidable movement between an inner position (the "hose locking" position) shown in solid lines in FIGS. 6 and 7 and an outer position (the "hose unreeling" position) shown in dashed lines in FIG. 7. To this end, handle 82 is formed of a solid aluminum bar and has tabs 84 formed at each outer end. The tabs 84 are provided with straight parallel sides which are adapted to be slidably received in straight slots 51 formed in each of the arms 50 to extend longitudinally along the length thereof. Handle 82 is retained at each end in the slots 51 by means of a bolt 86, a spacer 87 and a pair of washers 88 and 89. Bolts 86 are threadedly received in threaded bores 85 extending axially inwardly from the outer ends of handle 82. The retaining arrangement is shown clearly in the detail exploded view shown in FIG. 8.

The mounting means for handle 82 also includes a spring means for biasing handle 82 towards its inner position. Such spring means comprises a pair of tension springs 90, each of which is mounted at its lower end on a bolt 94 secured to an associated arm 50 below a slot 51 therein by means of a pair of nuts 95 as shown in FIG. 7. At their upper ends, each of the springs 90 has a loop 93 therein which is received in a peripheral groove in spacer 87 to provide a secure mounting for the upper ends of the springs 90. By this arrangement, springs 90 urge the handle 82 inwardly to the "hose locking" position shown in solid lines in FIGS. 6 and 7. Springs 90 are expandable to permit handle 82 to be moved radially outwardly to the "hose unreeling" position shown in dashed lines in FIG. 7.

The handle means 80 also comprises a hose contacting means carried by the handle 82, such means comprising a bracket 100 welded at its upper ends to handle 82 and extending radially inwardly therefrom into the space between the side plates 14 of the reel 10 in an arrangement shown in FIG. 7. A friction pad 102 is mounted, by means of a pair of bolts 104, on the radially inward portion of the bracket 100 so as to provide an abrasion resistant contact with the hoses wound on the hose reel 10.

As is shown in FIG. 7, the hose contacting means is positioned in frictional contact with the outer portion of the wound hose at the inner position of the handle 82 to thereby lock the reel 10 against rotation relative to the arms 50 and to hold the hose to prevent unreeling thereof. Further, the hose contacting means is out of contact with the wound hose at the outer position of handle 82, as shown by the dashed line position in FIG. 7, to thereby permit the unreeling of the hoses from the hose reel.

By the construction and arrangement described above, the handle means 80 is movable to a first transport position (the "hose locking" position) in which handle 82 is in an inner position to thereby place pad 102 of the hose contacting means in frictional contact with the outer portion of the wound hoses for locking the reel 10 against rotation relative to arms 50 and for holding the hose to prevent unreeling thereof. Handle means 80 is also movable to a second transport position (the "hose unreeling" position) in which handle 82 is located in its outer position to thereby position the hose contacting means out of contact with the wound hose and to thereby permit the unreeling of the hoses 22 and 24 from the reel 10.

It will be apparent that the embodiment of the invention shown in FIGS. 6–8 provides a very effective design for ensuring that the hose reel stays locked in a tightly wound condition when this is desired, such as when being carried by handle 81, during storage, or during the loading and unloading thereof onto or off of a fire truck. This is achieved because the spring biased hose contacting means is always urged against the coiled hose by the action of the tension springs 90 to thereby keep the hose from unreeling. Moreover, by the very simple and quick action of simply picking up the hose reel by means of the handle 82 and raising it to its outer position, the hose reel can be carried through an unreeling movement. By using the handle 82 to carry the hose reel, the hose contacting means is positioned at a location out of contact with the hoses 22 and 24 to release the reel 10 for free rotation as the fireman lays down the hoses 22 and 24 during an unreeling procedure.

What is claimed is:

1. A portable hose supply constructed and arranged for stowing two hoses in a wound condition and deploying quickly the two hoses simultaneously in parallel relation for use in supplying water for water powered devices comprising:

a reel including a generally open cylindrical frame having a pair of circular side plates and means for securing said side plates together in spaced apart opposed relation to define a generally annular space therebetween for receiving wound hose, and an axle mounted at a central part of said frame to extend transversely between said side plates on a rotational axis;

a pair of flexible hoses located within said annular space and wound together in parallel relation in a flattened condition one on top of the other to overlap throughout their length so that both hoses can be unwrapped from said annular space simultaneously for conjoint deployment thereof, said hoses having couplings at the ends thereof ; and means for transporting said reel and said pair of hoses including means providing a handle secured to said axle to provide a grip portion whereat said transport means can be gripped for use in transporting the hose reel or deploying said pair of hoses together at the same time.

2. A hose supply according to claim 1 wherein said means for securing said side plates together include a plurality of tie members spaced around said axle at locations radially outwardly thereof to provide a central support for said wound hoses.

3. A hose supply according to claim 2 wherein each of said hoses has a male and female coupling connected on the ends thereof, said couplings on the inner ends of said hoses being received in a space of said reel between said side plates and radially inwardly of said tie members.

4. A hose supply according to claim 2 wherein said tie members are spaced radially from said axle equally and are spaced apart from one another equally.

5. A hose supply according to claim 4 wherein said tie members comprise tie bolts and include cylindrical sleeves enclosing each of said tie bolts.

6. A hose supply according to claim 1 wherein said side plates are made of a strong lightweight plastic material and have formed therein a plurality of radially extending ribs for strengthening the same.

7. A hose supply according to claim 1 wherein one of said hoses are made of a lightweight, single-jacket rack hose construction.

8. A hose reel according to claim 1 wherein said handle means comprises a first handle mounted on the outer ends of said pair of arms to extend therebetween to provide a first grip portion for use in transporting the hose reel.

9. A hose supply according to claim 1 wherein each of said hoses has a male and a female coupling connected on the ends thereof, said coupling on the other end of one of said hoses being a male coupling, said coupling on the outer end of said other hose being a female coupling, said outer end couplings being, in the wound condition of said hoses, located to be accessible whereby said outer end couplings are easily accessible during a deployment operation.

10. A portable hose reel for use in deploying a quantity of flexible hose wound within an annular space defined thereby comprising:

a reel including a generally open cylindrical frame having a pair of circular side plates and means for securing said side plates together in spaced apart opposed relation to define a generally annular space therebetween for receiving wound hose, and an axle mounted at a central part of said frame to extend transversely between said side plates on a rotational axis, and means for transporting said reel including a pair of arms rotatably mounted at one end to said axle and extending radially outwardly from said axle to a location outwardly of the outer rim of said side plates, and means providing a handle secured to and extending between the extended ends of said arms to provide a grip portion whereat said transport means can be gripped for transporting the hose reel, said side plates being made of a strong lightweight plastic material, said side plates having a widened hub at the central portion thereof, and said reel including a pair of metal central plates each of which is secured to said axle and to one of said side plates to provide a hub for said reel.

11. A hose reel according to claim 10 wherein said axle has hollow end portions and wherein said reel includes a pair of roll pins, each roll pin being mounted in a hollow end portion of said axle to extend transversely to the axis thereof, said hollow end portions providing access to said roll pins for engagement thereof by a crank for causing rotation of said reel.

12. A portable hose reel for use in deploying a quantity of flexible hose wound within an annular space defined thereby comprising:

a reel including a generally open cylindrical frame having a pair of circular side plates and means for securing said side plates together in spaced apart opposed relation to define a generally annular space therebetween for receiving wound hose, and an axle mounted at a central part of said frame to extend transversely between said side plates on a rotational axis, and means for transporting said reel including a pair of arms rotatably mounted at one end to said axle and extending radially outwardly from said axle to a location outwardly of the outer rim of said side plates, and means providing a handle secured to and extending between the extended ends of said arms to provide a grip portion whereat said transport means can be gripped for transporting the hose reel, said side plates being generally dish-shaped and having their outer rims formed in an outwardly curved configuration.

13. A portable hose reel for use in deploying a quantity of flexible hose wound within an annular space defined thereby comprising:

a reel including a generally open cylindrical frame having a pair of circular side plates and means for securing said side plates together in spaced apart opposed relation to define a generally annular space therebetween for receiving wound hose, and an axle mounted at a central part of said frame to extend transversely between said side plates on a rotational axis, and means for transporting said reel including a pair of arms rotatably mounted at one end of said axle and extending radially outwardly from said axle to a location outwardly of the outer rim of said side plates, and means providing a handle secured to and extending between the extended ends of said arms to provide a grip portion whereat said transport means can be gripped for transporting the hose reel, said handle means comprising a pivot extending transversely between the spaced apart outer ends of said pair of arms, a pair of handles providing a pair of grip portions and means for pivotally mounting said handles on said pivot.

14. A hose reel according to claim 13 wherein said means for pivotally mounting said handles comprises a pair of bars pivotally mounted on said pivot at a medial part of said bars, one of said handles being mounted on one end of said bars and the other of said handles being mounted on the other end of said bars.

15. A hose reel according to claim 14 wherein said handle means is constructed and arranged so that one of said handles is spaced a first distance from said pivot and the other of said handles is spaced a second distance from said pivot greater than said first distance.

16. A hose reel according to claim 15 wherein said handle means is movable between a first transport position in which said other handle is in contact with an outer portion of said wound hose for locking said reel against rotation and said one handle is located outwardly of the outer rims of said side plates to provide a grip portion for use in carrying the hose reel and a second transport position in which said one handle is located out of contact with the wound hose and said other handle is located outwardly of the outer rims of said side plates to provide a grip portion for use in transporting the hose reel to unreel the hoses from said reel.

17. A portable hose reel for use in deploying a quantity of flexible hose wound within an annular space defined thereby comprising:

a reel including a generally open cylindrical frame having a pair of circular side plates and means for securing said side plates together in spaced apart opposed relation to define a generally annular space therebetween for receiving wound hose, and an axle mounted at a central part of said frame to extend transversely between said side plates on a rotational axis, and means for transporting said reel including a pair of arms rotatably mounted at one end of said axle and extending radially outwardly from said axle to a location outwardly of the outer rim of said side plates, and means providing a handle secured to and extending between the extended ends of said arms to provide grip means whereat said transport means can be gripped for transporting the hose reel, said handle means comprising a first handle mounted on the outer ends of said pair of arms to extend therebetween to provide a first grip portion for use in transporting the hose reel, said handle means comprising a second handle movably mounted on said pair of arms at a location radially inwardly of said first handle, and means for mounting said second handle on said arms for movement between an inner position and an outer position.

18. A hose reel according to claim 17 including spring means for biasing said second handle toward said inner position.

19. A hose reel according to claim 18 wherein said handle means comprises a hose contacting means carried by said second handle, said hose contacting means being positioned in frictional contact with the outer portion of said wound hose at said inner position of said second handle for locking said reel against rotation relative to said arms and holding hose to prevent unreeling thereof, and said hose contacting means being out of contact with said wound hose at said outer position of said second handle to permit the unreeling of said hoses from said reel.

20. A hose reel according to claim 19 wherein said second handle is movable to be adjacent said first handle in said outer position thereof whereby said second handle can be gripped for use in transporting the reel for hose unreeling purposes.

* * * * *